US005269653A

United States Patent [19]

Evans

[11] Patent Number: 5,269,653

[45] Date of Patent: Dec. 14, 1993

[54] AEROFOIL COOLING

[75] Inventor: Neil M. Evans, Bristol, England

[73] Assignee: Rolls-Royce plc, London, England

[21] Appl. No.: 932,697

[22] Filed: Aug. 20, 1992

[30] Foreign Application Priority Data

Aug. 24, 1991 [GB] United Kingdom ..... 9118290

[51] Int. Cl.[5] ..... F01D 5/18

[52] U.S. Cl. ..... 416/97 R; 415/115

[58] Field of Search ..... 415/115, 116; 416/95, 416/97 R

[56] References Cited

U.S. PATENT DOCUMENTS

| | | | |
|---|---|---|---|
| 3,051,439 | 8/1962 | Hilton | 416/97 R |
| 4,073,599 | 2/1978 | Allen et al. | 416/97 R |
| 4,257,737 | 3/1981 | Andress et al. | 415/115 |
| 4,505,639 | 3/1985 | Groess et al. | 415/115 |
| 4,514,144 | 4/1985 | Lee | 416/97 R |
| 4,738,587 | 4/1988 | Kildea | 416/96 R |
| 4,820,122 | 4/1989 | Hall et al. | 416/97 R |

FOREIGN PATENT DOCUMENTS

| | | | |
|---|---|---|---|
| 2036506 | 3/1969 | France . | |
| 202303 | 11/1983 | Japan | 416/97 R |
| 1327317 | 8/1973 | United Kingdom . | |
| 1087527 | 10/1980 | United Kingdom | 416/97 R |
| 2202907A | 10/1988 | United Kingdom . | |
| 2210415A | 6/1989 | United Kingdom . | |
| 2238582A | 6/1991 | United Kingdom . | |

*Primary Examiner*—John T. Kwon

*Attorney, Agent, or Firm*—Oliff & Berridge

[57] ABSTRACT

There is provided an aerofoil 11 having a passage 17 supplied with cooling fluid from passage 13. When the leading edge area 14 of the aerofoil 11 erodes/corrodes the passage 17 becomes exposed so that the cooling fluid effects film cooling of the leading edge area.

6 Claims, 1 Drawing Sheet

AEROFOIL COOLING

This invention relates to aerofoils and more particularly to aerofoils for us in a hot fluid stream.

According to a first aspect of the present inventions there is provided an aerofoil having a passage for receiving cooling fluid, said passage being located towards a selected portion of the aerofoil whereby, in use, erosion and/or corrosion of said selected portion exposes said passage to allow the cooling fluid to effect film cooling of said selected portion.

In one preferred arrangement said selected portion is the leading edge area of the aerofoil.

Preferably the passage is elongate in the direction of said leading edge and is generally parallel thereto. Said passage may extend the entire length of the leading edge of the aerofoil.

In an alternative arrangement further of said passages are provided. In some embodiments the passages may be in a series spaced apart in the direction of the selected portion and extending theretowards. The passage may be generally perpendicular relative to the selected portion such as the leading edge of the aerofoil and the end of each passage nearest the selected portion is blanked off.

According to a preferred embodiment said passage or passages communicate via one or more feed passages with a main passage for cooling fluid. This main passage is arranged primarily for providing convection cooling of the aerofoil. Preferably said main passage has two ends, one adapted to be supplied with cooling fluid and the other blanked off.

Conveniently at least the leading edge area of the aerofoil is provided with an external thermal barrier coating.

According to a second aspect of the present invention there is provided a method of cooling an aerofoil comprising the steps of providing a passage located towards a selected portion of said aerofoil, supplying a cooling fluid to said passage and allowing erosion and/or corrosion of said selected portion thereby to expose said passage so that the fluid will effect film cooling of said selected portion of the aerofoil.

Figure 1:
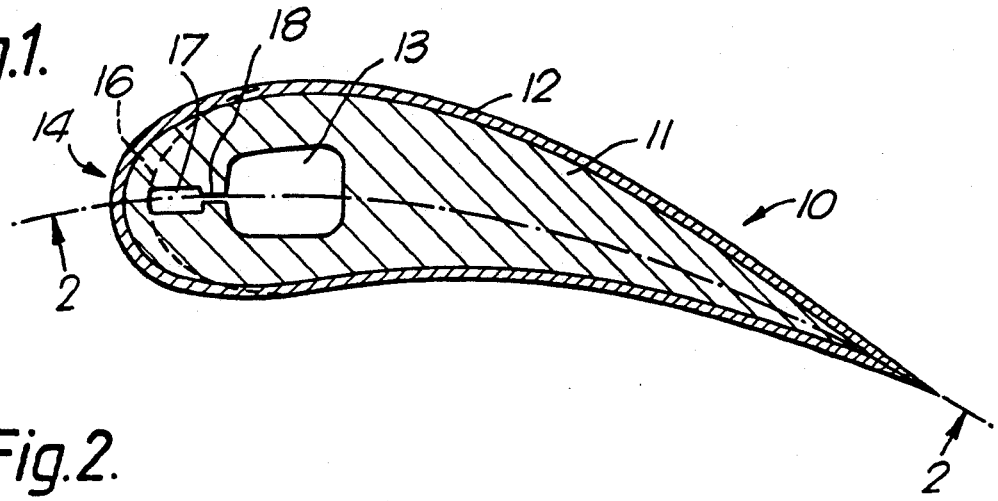
Figure 2:
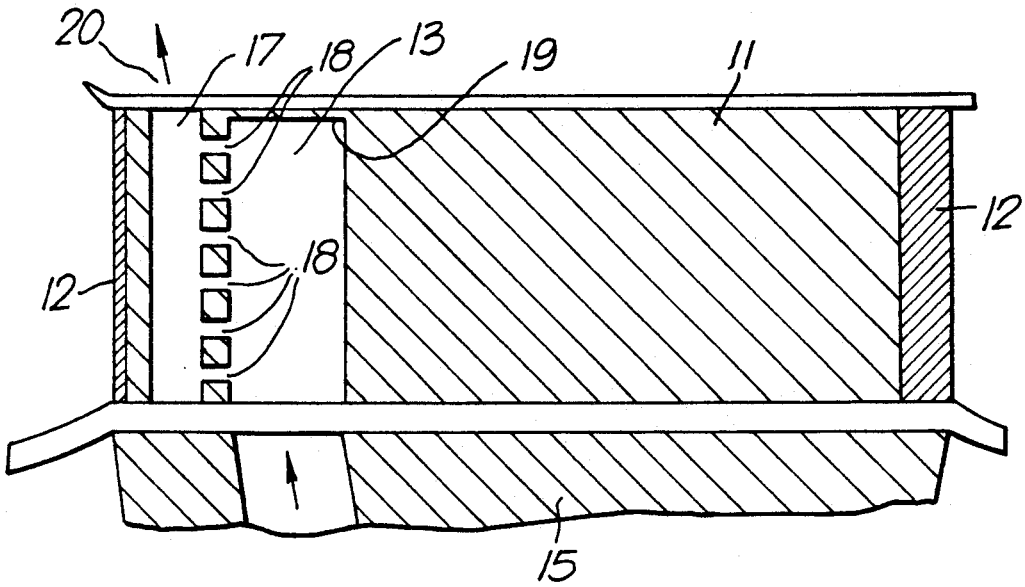
Figure 3:
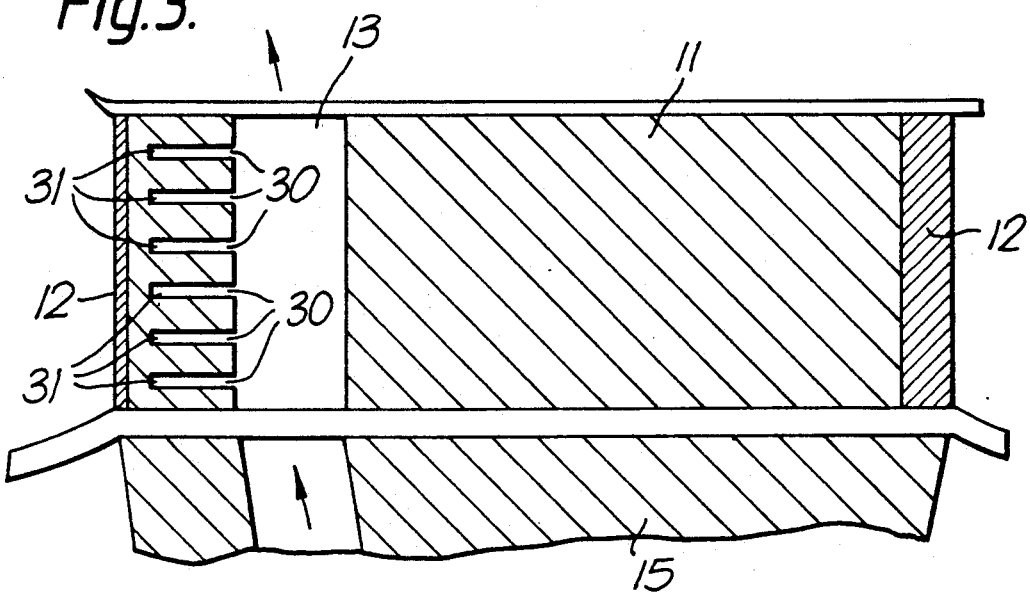

Embodiments of the invention will now be described in more detail. The description makes reference to the accompanying diagrammatic drawings in which:

FIG. 1 is a lateral cross-section through an aerofoil according to the present invention, and FIG. 2 is a lengthwise cross-section on line 2–2 of FIG. 1, and FIG. 3 is a lengthwise cross-section similar to FIG. 2 through another aerofoil according to the present invention.

FIGS. 1 and 2 show an aerofoil arrangement 10 comprising an aerofoil 11 having a Thermal Barrier Coating 12 or TBC for short. The aerofoil 11 is formed with a main passage 13 in which is circulated a flow of cooling fluid, in this case air. Such passages 13 are well known and serve to cool the leading edge area 14 of the aerofoil by means of convection, the cool air being heated by the hotter sections of the aerofoil 11 surrounding the passage 13. The supply of cool air is in this embodiment effected through a root portion 15 of the aerofoil arrangement 10. This particular aerofoil is intended to be one of an annularly spaced series in a section of a gas turbine engine.

Use of the aerofoil will eventually result in the deterioration and eventual breach of the TBC 12 which will leave the material of the aerofoil 11, generally metal, exposed to erosion and corrosion such as oxidation. This is indicated in FIG. 1 by broken line 16 which shows the effective movement of the leading edge of the aerofoil 11 downstream.

In the aerofoil 11 is provided a passage 17 which extends along the length of the aerofoil 11 at a generally constant distance from the leading edge area 14 and adjacent thereto. The distance shown in the figures is exaggerated for the purposes of clarity. The passage 17 is supplied with cooling fluid from the main passage 13 by a plurality of spaced feed passages 18.

When the TBC 12 has deteriorated and been breached the leading edge of the aerofoil 11 may soon be eroded to the position 16, the passage 17 being gradually exposed to the surrounding atmosphere. The cooling air from the passage 17 is now able to effect film cooling of the leading edge. This cools the material of the aerofoil at the leading edge which in turn slows the process of erosion thereby prolonging the remaining operating life of the aerofoil 11.

In the arrangement shown the main passage 13 is blanked off at 19 towards its radially outermost tip. This assists in the passage of the cooling fluid into the passage 17. The passage 17 also exhausts cooling fluid from its radially outermost tip at 20 so that the cooling fluid in passages 17 and 13 can be replenished continually. However, in alternative arrangements the passage 17 may be fed with cooling fluid directly.

It will be appreciated that other cooling passages 13 could be provided by the aerofoil 11 as is well known and also further passages 17 could be provided where needed. Also the feed passages 18 could be replaced by a single feed passage, either of limited radial extent or possibly extending the length of the passage 17. In addition the passage 17 may extend along only a limited radial length of the aerofoil. For example, it may be possibly be provided only in the radially outermost half of the length of the aerofoil. The passages 13 and 17 can also be of any desired cross-section instead of generally rectangular as shown.

When a length of the passage 17 is exposed it may, if given certain dimensions and conditions, trap a relatively stagnant portion of the passing hot gases and serve to heat insulate to come extent that portion of the aerofoil behind the exposed passage 17.

As an alternative and as shown in FIG. 3, a number of spaced blank passages 30 could be provided, the blank ends 31 of the passages located adjacent the leading edge 14 of the aerofoil and the passages 30 being adapted to receive cooling fluid by communication with a main passage 13. Erosion of the leading edge of the aerofoil 11 would expose an increasing number of passages 30 which would then provide the necessary film cooling of the leading edge. In FIG. 3 the arrangement is in many ways similar to that shown in FIGS. 1 and 2 and so like parts have been given like reference numerals.

It will also be apparent that although the above description has concentrated on erosion/corrosion and subsequent cooling of the leading edge of an aerofoil, it is equally suited to protecting and increasing the useful life of other vulnerable portions of the aerofoil, for example the trailing edge. Also any aerofoil, not just those in gas turbine engines, can be cooled using this technique if conditions allow.

I claim:

1. An aerofoil having an internal cooling arrangement comprising a main passage and a plurality of blank passages, each of said blank passages having a blank end extending towards a selected portion of the aerofoil and an open end in communication with the main passage of the internal cooling arrangement whereby, in use, at least one of erosion and corrosion of said selected portion of the aerofoil exposes the blank end of at least one of said blank passages thereby opening at least one passageway to allow a flow of cooling fluid to flow through said at least one passageway to effect film cooling of said selected portion.

2. An aerofoil as claimed in claim 1 wherein the blank passages are arranged in a series, spaced apart and extend towards said selected portion.

3. An aerofoil as claimed in claim 2 wherein the blank passages are generally perpendicular relative to the selected portion and each of said blank passages is blanked off at an end nearest the selected portion.

4. An aerofoil as claimed in claim 1 having an external surface and an internal arrangement of cooling passages adapted to receive, in use, a cooling fluid, the internal arrangement of cooling passages including at least one further passage extending towards said selected portion of said aerofoil, said at least one further passage having two ends, one end being blanked off and the other end communicating via at least one feed passage with said main passage in the internal arrangement to receive cooling fluid whereby, in use, at least one of erosion and corrosion of said selected portion of the aerofoil in the region of said at least one further passage exposes said at least one further passage to allow the cooling fluid to escape from said at least one further passage to effect film cooling of said selected portion.

5. An aerofoil as claimed in claim 1 wherein at least a leading edge area of the aerofoil is provided with an external thermal barrier coating.

6. A method of cooling an aerofoil comprising the steps of providing at least one blank passage extending towards a selected portion of said aerofoil, supplying a cooling fluid to said at least one blank passage and allowing at least one of erosion and corrosion of said selected portion thereby to expose said at least one blank passage so that the fluid will escape through said at least one blank passage and effect film cooling of said selected portion of the aerofoil.

* * * * *